US007913426B2

(12) United States Patent
Valat et al.

(10) Patent No.: US 7,913,426 B2
(45) Date of Patent: Mar. 29, 2011

(54) FOOTWEAR ARTICLE WITH LIMITED ROTATIONAL MOVEMENT AND DAMPED END OF COURSE

(76) Inventors: Gérard Valat, Aix en Provence (FR); Cédric Ragot, Paris (FR)

( * ) Notice: Subject to any disclaimer, the term of this patent is extended or adjusted under 35 U.S.C. 154(b) by 1148 days.

(21) Appl. No.: 10/562,433

(22) PCT Filed: Jun. 18, 2004

(86) PCT No.: PCT/FR2004/001532

§ 371 (c)(1),
(2), (4) Date: Dec. 28, 2005

(87) PCT Pub. No.: WO2005/013744

PCT Pub. Date: Feb. 17, 2005

(65) Prior Publication Data

US 2006/0168849 A1 Aug. 3, 2006

(30) Foreign Application Priority Data

Jul. 9, 2003 (FR) ..... 03 08415

(51) Int. Cl.
*A43B 5/14* (2006.01)

(52) U.S. Cl. ..... 36/131; 36/102

(58) Field of Classification Search ..... 36/89, 102, 36/113, 117.4, 131

See application file for complete search history.

(56) References Cited

U.S. PATENT DOCUMENTS

| | | | | |
|---|---|---|---|---|
| 3,945,134 | A | 3/1976 | Ramer | |
| 5,090,138 | A * | 2/1992 | Borden | 36/102 |
| 5,224,281 | A * | 7/1993 | Nerrinck et al. | 36/118.3 |
| 5,446,976 | A * | 9/1995 | Donnadieu et al. | 36/117.2 |
| 5,909,885 | A | 6/1999 | Borel | |
| 6,725,577 | B2 * | 4/2004 | Mazzarolo | 36/131 |
| 6,883,256 | B2 * | 4/2005 | Mazzarolo | 36/131 |

FOREIGN PATENT DOCUMENTS

WO WO 01/35781 5/2001

* cited by examiner

*Primary Examiner* — Mickey Yu
*Assistant Examiner* — Sharon M Prange
(74) *Attorney, Agent, or Firm* — Young & Thompson

(57) ABSTRACT

A footwear article (1), for practicing a sport, in particular, motorcycling, includes a rigid body (2), for housing the foot of a user, running in an extension direction (8), a rigid upper (4), for housing the leg of a user and running essentially in an elevation direction (10), a joint (6), permitting the rotation of the upper with relation to the body in a transverse direction (12), stop elements for limiting the rotation of the upper (4) with relation to the body (2) in the transverse direction (12) within a range of rotation limits over 50 to 70 degrees, damping elements (14), generating a torque which opposes the approach of the first and second stop elements, the damping elements having an inactive state when the upper and the body move relative to each other within a normal rotation range of 30 to 50 degrees.

7 Claims, 2 Drawing Sheets

FOOTWEAR ARTICLE WITH LIMITED ROTATIONAL MOVEMENT AND DAMPED END OF COURSE

FIELD OF THE INVENTION

BACKGROUND OF THE INVENTION

The present invention relates to an item of footwear which is intended for sporting use.

It is particularly suitable for protecting a user who is participating in motor sports and more particularly motorcycling. However, it may also be found to be advantageous for use in snowboarding, mounting biking, jet-skiing or hiking, in particular.

WO-A-01 35781 describes an item of footwear of this type, and more particularly a motorcycle boot comprising:

- a first rigid shell which defines a body which is intended to receive the foot of a user and which extends in an extension direction,
- a second rigid shell which defines an upper which is intended to receive the leg of the user and which extends substantially in an upright direction,
- an articulation which connects the body and the upper, said articulation allowing the upper to rotate relative to the body in a transverse direction which is substantially perpendicular to the extension direction and the upright direction, in order to allow flexion of the foot of the user,
- stop means comprising a first element which is connected to the body and a second element which is connected to the upper, one coming into contact with the other in order to limit the rotation of the upper relative to the body in the transverse direction within a maximum rotation range,
- damping means which produce a couple in the transverse direction opposing the moving together of the first and second stop elements.

That item has been found to be strong and protects the user effectively. However, it is sometimes desirable to provide a simpler, lighter item which affords greater comfort in use.

Furthermore, U.S. Pat. No. 5,909,885 describes a roller boot which is provided with an energisation device which differs from WO-A-01 35781 in that

- the stop means comprise:
  - first stop means which comprise a first element which is connected to the body and a second element which is connected to the upper, one coming into contact with the other in order to limit the rotation of the upper relative to the body in the transverse direction in a first rotation direction,
  - second stop means which comprise a first element which is connected to the body and a second element which is connected to the upper, one coming into contact with the other in order to limit the rotation of the upper relative to the body in the transverse direction in a second rotation direction counter to the first rotation direction,
- the damping means comprise:
  - first damping means which produce a couple in the transverse direction opposing the moving together of the first and second stop elements of the first stop means, and
  - second damping means which produce a couple in the transverse direction opposing the moving together of the first and second stop elements of the second stop means.

However, those features are intended to improve the efficacy of the skating and not the protection of the lower leg, in particular the ankle, of the user.

SUMMARY OF THE INVENTION

So that the item of footwear is comfortable whilst at the same time protecting the user effectively against any risk of injury, in accordance with the invention the maximum rotation range in the transverse direction extends over from 50 degrees to 70 degrees and the normal rotation range in the transverse direction extends over from 30 degrees to 50 degrees and is substantially centred relative to the maximum rotation range.

In this manner, the normal rotation range is extended enough for the user to be able to freely flex his ankle during normal use of the item of footwear. Although the remainder of the "angular travel" for stopping the rotational movement progressively before the risk of injury and the arrival at abutment may be reduced, it is found to be sufficient for a given number of sports which do not require extreme protection.

Advantageously, the damping means comprise a thin flexible plate which has a first end which is connected to one of the two shells and a second end which moves freely within the normal rotation range and which comes into abutment with the other shell between the normal rotation range and the maximum rotation range.

This construction is simple and provides good strength at moderate cost.

In accordance with another feature of the invention, the thin flexible plate is connected to said shell near the articulation. This construction provides the user with a high level of comfort.

The thin flexible plate preferably has a curved portion which extends around the articulation, which allows the thin flexible plate to be readily connected to the shell.

BRIEF DESCRIPTION OF THE DRAWINGS

The invention will be appreciated even more clearly from the following description given with reference to the appended drawings, in which.

DETAILED DESCRIPTION OF EMBODIMENTS

Figure 1:
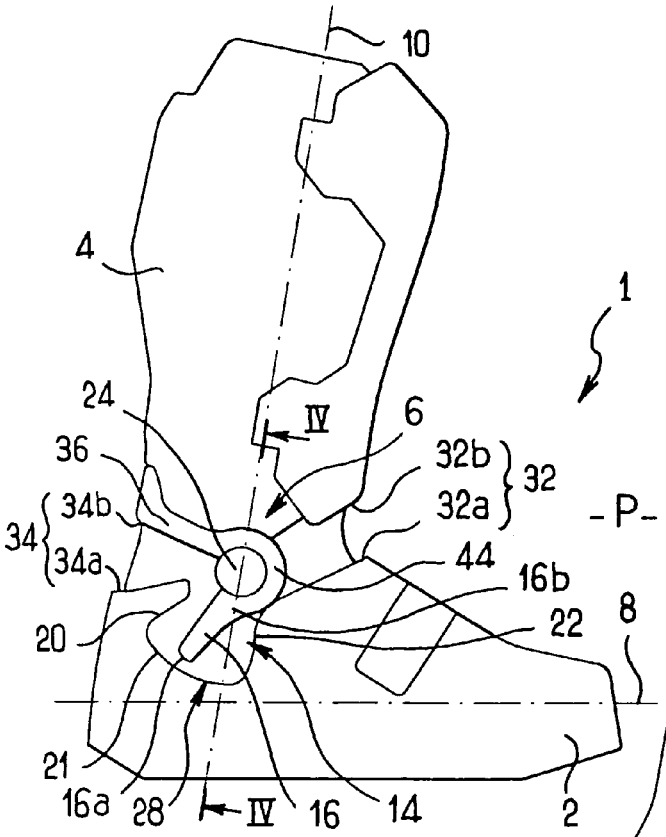
FIG. 1 shows a motorcycle boot in accordance with the invention in a rest position.

FIGS. 1 to 4 illustrate a boot 1 comprising a body 2 which is intended to receive the foot of a user in the lower portion, an upper 4 which is intended to receive the leg of a user in the upper portion, an inner lining 3 which extends inside the upper 4 and the body 2, an articulation device 6 which connects the upper 4 to the body 2 in the intermediate portion, stop means 32, 34 and damping means 14.

The inner lining 3 is relatively flexible. It is advantageously produced, during conventional shoemaking, from leather or synthetic material and provides the user with comfort. The body 2 and the upper 4 in conjunction with the articulation device 6 ensure the protection of the user. The body 2 and the upper 4 each comprise a relatively rigid shell, which is advantageously produced from plastics material and which is intended to protect the lower limbs of the user. Those shells can be perforated locally. The body extends in an extension direction 8 which is substantially horizontal when the user places his foot on a horizontal surface whilst the upper extends in an upright direction 10 which is substantially vertical.

Figure 2:
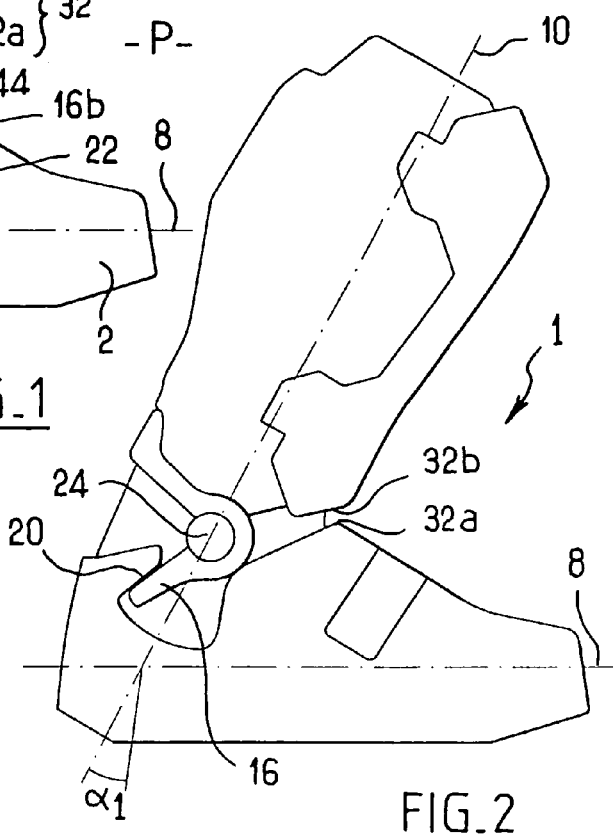
FIG. 2 shows the boot of FIG. 1 in a flexion position.
Figure 3:
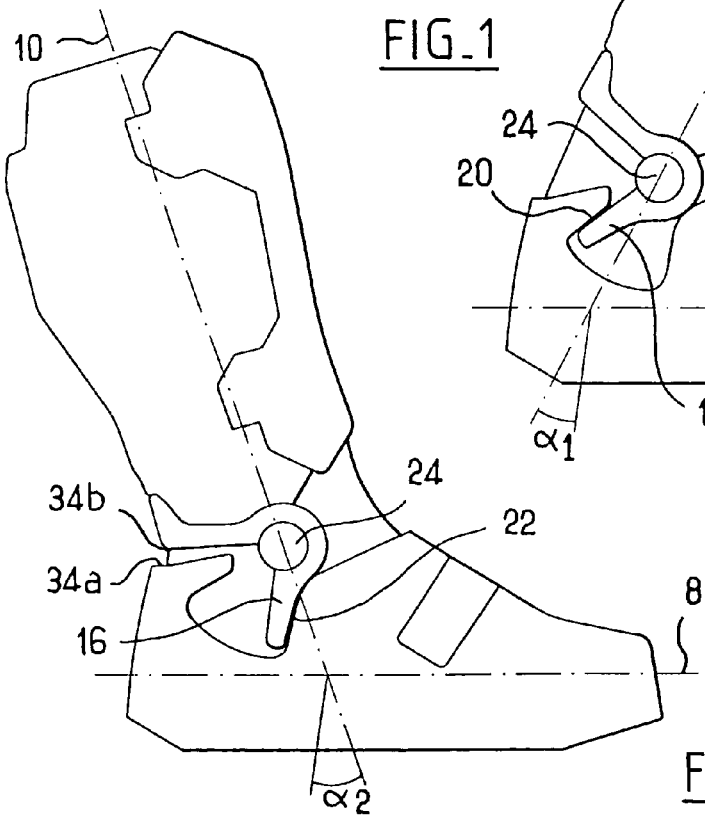
FIG. 3 shows the boot of FIG. 1 in an extension position.

The extension direction 8 and the upright direction 10 define a centre plane P which is parallel with the plane of illustration of FIGS. 1 to 3. The boot 1 further has a transverse direction 12 which extends substantially perpendicularly to the extension direction 8 and the upright direction 10.

The articulation device 6 brings about the rotation of the upper 4 relative to the body 2 in the transverse direction 12. It comprises two articulation pivots 24, 26 which are arranged substantially symmetrically relative to the plane P and which extend in the transverse direction 12 through the body 2 and the upper 4.

The stop means 32, 34 comprise flexion stop means 32 and extension stop means 34. The flexion stop means 32 and the extension stop means 34 each comprise a first portion 32*a*, 34*a* which is connected to the body and a second portion 32*b*, 34*b* which is connected to the upper 4, said first and second portions of the flexion and extension stop means coming into abutment with each other in order to stop the rotation of the upper 4 relative to the body 2 in the transverse direction 12 in terms of flexion and extension, respectively.

The damping means 14 are constituted by two thin resiliently deformable plates 16, 18 which are connected to the upper 4 and which each move inside a housing 28 which is provided in the body 2 and which is delimited by a flexion stop surface 20, a pronation/supination stop surface 21 and an extension stop surface 22. The housings 28 and in particular the flexion stop surface 20, pronation/supination stop surface 21 and extension stop surface 22 thereof are arranged substantially symmetrically relative to the plane P.

The two thin deformable plates 16, 18 are integrated in a unitary damping element 30 which is of resiliently deformable material and which further comprises a connection element 36 which retains said thin deformable plates relative to the upper 4. The damping element 30 is also substantially symmetrical relative to the centre plane P.

The thin deformable plates 16 extend in the direction of the articulation axis and substantially in the upright direction. They each comprise a free end 16*a*, 18*a* and an end 16*b*, 18*b* which is connected to the connection element 36. The connection element 36 is substantially U-shaped comprising two branches 40*a*, 40*b* which extend substantially in the extension direction 8 and which are connected to each other by a base 42 which extends substantially in the transverse direction 12. The base 42 includes a retention stud 38 which is introduced in the upper 4 in the extension direction 8, whilst the branches 40*a*, 40*b* each terminate in a curved portion 44*a*, 44*b* which is substantially circular and which extends in the transverse direction 12 around the pivots 24, 26, under the enlarged head of said pivots 24, 26. The connection element 36 and the end 16*b*, 18*b* of the thin flexible plates which are connected to the curved portions 44*a*, 44*b* are thus completely retained relative to the upper 4 by means of the curved portions 44*a*, 44*b* and the retention stud 38. Furthermore, the damping element 30 can readily be disassembled and replaced by the curved portions 44*a*, 44*b* being deformed. In order to prevent inadvertent disassembly and in order to protect it, the thin plates 16, 18 are advantageously retained in the housings 28 behind a cover (not illustrated).

As illustrated in FIGS. 1 and 2, in the event of a flexion movement of the ankle of a user about the transverse direction 12, the upper 4 pivots about the pivots 24, 26, the thin plates 16, 18 move freely in the housings 28 until the free end 16*a*, 18*a* of the thin plates 16, 18 come into contact with the flexion stop surfaces 20 of the housings 28. The thin plates 16, 18 then become deformed progressively in terms of flexion in the transverse direction 12 until the two portions 32*a*, 32*b* of the flexion stop means 32 come into contact with each other.

As indicated in FIG. 2, the magnitude $\alpha_1$ of the free flexion movement allowed by the articulation device 6, without any deformation of the thin flexible plates 16, 18, is approximately 20 degrees relative to the initial position illustrated in FIG. 1. Subsequently, over a maximum flexion magnitude of approximately 5 additional degrees, the thin flexible plates 16, 18, becoming deformed in terms of flexion, oppose the continuation of the flexion movement and thus damp any impact against the flexion stop means 32.

Conversely, as illustrated in FIGS. 1 and 3, during an extension movement of the ankle of a user about the transverse direction 12, the upper 4 pivots about the pivots 24, 26, the thin plates 16, 18 move freely in the housings 28 until the free end 16*a*, 18*a* of the thin plates 16, 18 come into contact with the extension stop surfaces 22 of the housings 28. The thin plates 16, 18 then become deformed progressively in terms of flexion in the transverse direction 12 until the two portions 34*a*, 34*b* of the extension stop means 34 come into contact with each other.

As indicated in FIG. 3, the magnitude $\alpha_2$ of the free extension movement allowed by the articulation device 6 is approximately 25 degrees relative to the initial position illustrated in FIG. 1. Subsequently, over a maximum extension magnitude of approximately 5 additional degrees, the thin flexible plates 16, 18, becoming deformed in terms of flexion, oppose the continuation of the extension movement and thus damp any impact against the extension stop means 34.

The extent of normal rotation allowing the user to move his ankle without any effort in the transverse direction 12 is therefore substantially 45 degrees. It is advantageously from 30 to 50 degrees, whilst the extent of maximum rotation between the stop position against the flexion stop means 32 and the stop position against the extension stop means 34 is substantially centred relative to the normal rotation and is advantageously from 50 degrees to 70 degrees. Furthermore, the thin flexible plates 16, 18 advantageously act over a rotation range of from 5 degrees to 20 degrees, both during the flexion movement and during the extension movement of the ankle.

Figure 4:
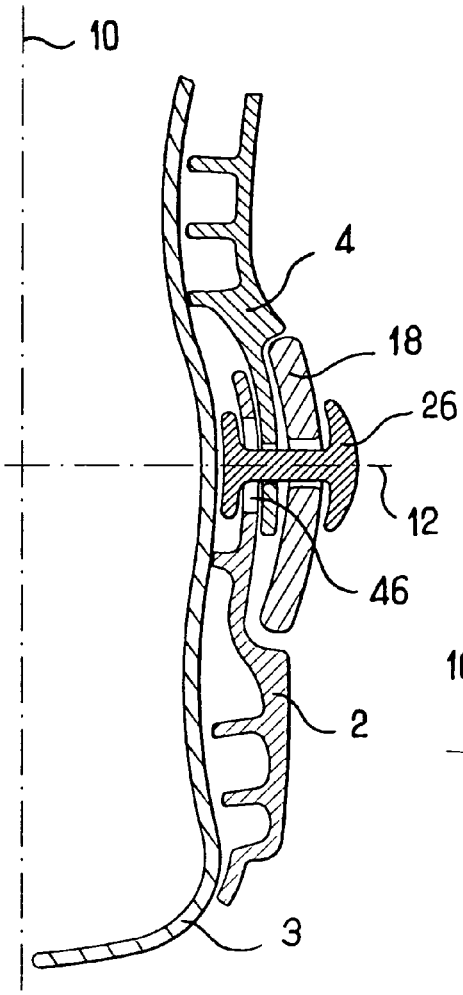
FIG. 4 is a partial cross-section along the arrow indicated IV-IV in FIG. 1 in a rest position.

Furthermore, the construction illustrated in FIGS. 1 to 4 allows the upper 4 to rotate relative to the body 2 in the extension direction 8 in order to allow pronation/supination of the ankle. For this purpose, as illustrated in FIG. 4 (the partial cross-section not illustrated is substantially symmetrical), the passages 46 which are provided in the body 2 and through which the pivots extend are of oblong form and extend in the upright direction 10. Slight translation movements in the upright direction 10 between the upper 4 and the body 2 are also possible in order to follow the movement of the malleolus of the user.

In the event of a pronation/supination movement of the ankle of a user about the extension direction 8, the pivots 24, 26 slide freely in the oblong holes 46 until the free end 16*a*, 18*a* of the thin plates 16, 18 come into contact with the pronation/supination stop surfaces 21 of the housings 28. The thin plates 16, 18 are then progressively compressed in order to damp the movement until the pivots 24, 26 reach a stop position in the oblong holes 46.

The magnitude of each of the free pronation and supination movements is approximately 10 degrees (that is to say, a free pronation/supination magnitude of approximately 20 degrees) and it is further advantageously possible to carry out a rotation in the extension direction of approximately 5 degrees before reaching the stop position in that articulation direction.

Figure 6:
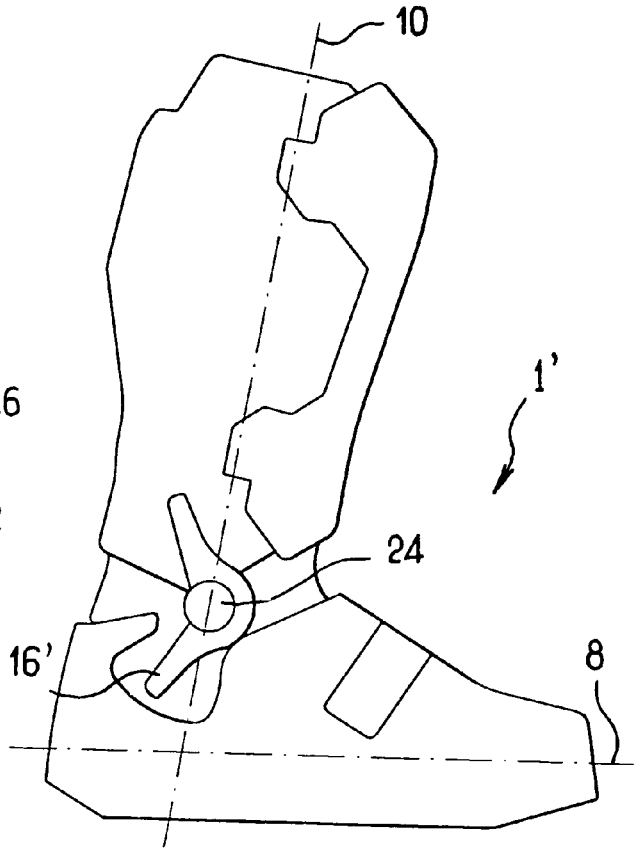
FIG. 6 shows a variant of the boot according to the invention.
Figure 5:
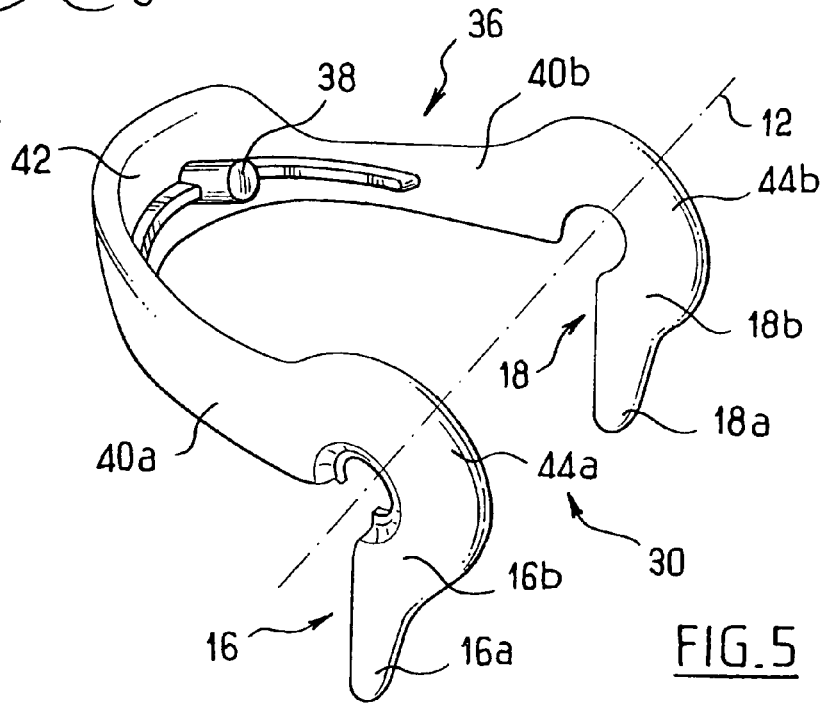
FIG. 5 is a perspective view of a damping element according to the invention.

FIG. 6 illustrates a boot 1' which substantially differs from the construction illustrated in FIGS. 1 to 4 in that the upper 4 can pivot only in the transverse direction and in that it comprises only a single thin flexible plate 16'.

The absence of translation and rotation in the upright direction 10 and rotation in the extension direction 8 is because circular holes are provided in place of oblong holes in the body 2, through which holes the pivots 24 extend.

It is not necessary to provide a second thin flexible plate since the thin flexible plate 16' has adequate characteristics.

The invention claimed is:

1. Item of footwear, which is intended for sporting use, comprising:

a first rigid shell which defines a body which is intended to receive a foot of a user and which extends in an extension direction, said first rigid shell including an area defining a housing on one lateral side of said body, a second rigid shell which defines an upper which is intended to receive the leg of the user and which extends substantially in an upright direction, an articulation which connects the body and the upper, said articulation allowing the upper to rotate relative to the body in a transverse direction which is substantially perpendicular to the extension direction and the upright direction, in order to allow flexion of the foot of the user, a stop limiter that limits the rotation of the upper relative to the body in the transverse direction within a maximum rotation range, said stop limiter comprising:

a first stop limiter comprising a first flexion element which is connected to a front of the body and a second flexion element which is connected to a front of the upper, one coming into contact with the other in order to limit the rotation of the upper relative to the body in the transverse direction in a flexion rotation direction, a second stop limiter comprising a first extension element which is connected to a rear of the body and a second extension element which is connected to a rear of the upper, one coming into contact with the other in order to limit the rotation of the upper relative to the body in the transverse direction in an extension rotation direction counter to the flexion rotation direction, damping means having an inactive state when the upper and the body move relative to each other within a normal rotation range, which is not zero and which is strictly included within the maximum rotation range, so that the damping means are active only when the upper and the body move relative to each other between the normal rotation range and the maximum rotation range, said damping means comprising:

a flexible plate which has a first end which is connected to the upper and a second end which moves freely within the normal rotation range and which comes into abutment with the housing of the body between the normal rotation range and the maximum rotation range to produce a force in the transverse direction opposing the moving together of the first and second flexion elements, and to produce a force in the transverse direction opposing the moving together of the first and second extension elements, said item of footwear being configured so that the maximum rotation range in the transverse direction extends over from 50 degrees to 70 degrees and the normal rotation range in the transverse direction extends over from 30 degrees to 50 degrees and is substantially centred relative to the maximum rotation range.

2. Item of footwear according to claim 1, wherein the flexible plate is connected to said upper near the articulation.

3. Item of footwear according to claim 2, wherein the flexible plate has a curved portion which extends around the articulation.

4. Item of footwear according to claim 1, wherein the flexible plate has a curved portion which extends around the articulation.

5. Item of footwear according to claim 1, wherein the flexible plate is active over a rotation range in the transverse direction of from 5 to 20 degrees.

6. Item of footwear, which is intended for sporting use, comprising:

a first rigid shell which defines a body which is intended to receive a foot of a user and which extends in an extension direction, a second rigid shell which defines an upper which is intended to receive the leg of the user and which extends substantially in an upright direction, an articulation which connects the body and the upper, said articulation allowing the upper to rotate relative to the body in a transverse direction which is substantially perpendicular to the extension direction and the upright direction, in order to allow flexion of the foot of the user, a stop limiter that limits the rotation of the upper relative to the body in the transverse direction within a maximum rotation range, said stop limiter comprising:

a first stop limiter comprising a first flexion element which is connected to a front of the body and a second flexion element which is connected to a front of the upper, one coming into contact with the other in order to limit the rotation of the upper relative to the body in the transverse direction in a flexion rotation direction, a second stop limiter comprising a first extension element which is connected to a rear of the body and a second extension element which is connected to a rear of the upper, one coming into contact with the other in order to limit the rotation of the upper relative to the body in the transverse direction in an extension rotation direction counter to the flexion rotation direction, damping means having an inactive state when the upper and the body move relative to each other within a normal rotation range, which is not zero and which is strictly included within the maximum rotation range, so that the damping means are active only when the upper and the body move relative to each other between the normal rotation range and the maximum rotation range, said damping means comprising:

two flexible plates which each have a first end which is connected to the upper and a second end which moves freely within the normal rotation range and which comes into abutment with the body between the normal rotation range and the maximum rotation range to produce a force in the transverse direction opposing the moving together of the first and second flexion elements, and to produce a force in the transverse direction opposing the moving together of the first and second extension elements, said item of footwear being configured so that the maximum rotation range in the transverse direction extends over from 50 degrees to 70 degrees and the normal rotation range in the transverse direction extends over from 30 degrees to 50 degrees and is substantially centred relative to the maximum rotation range wherein said two flexible plates are arranged symmetrically relative to a centre plane (P) which is defined by the extension direction and the upright direction, said two flexible plates being connected to each other at a respective said first end.

7. An item of footwear, which is intended for sporting use, comprising:

a first rigid shell which defines a body which is intended to receive a foot of a user and which extends in an extension direction, a second rigid shell which defines an upper which is intended to receive the leg of the user and which extends substantially in an upright direction, an articulation which connects the body and the upper, said articulation allowing the upper to rotate relative to the body in a transverse direction which is substantially perpendicular to the extension direction and the upright direction, in order to allow flexion of the foot of the user, a first stop limiter comprising a first flexion element which is connected to a front of the body and a second flexion element which is connected to a front of the upper, one coming into contact with the other in order to limit the rotation of the upper relative to the body in the transverse direction in a flexion rotation direction, a second stop limiter comprising a first extension element which is connected to a rear of the body and a second extension element which is connected to a rear of the upper, one coming into contact with the other in order to limit the rotation of the upper relative to the body in the transverse direction in an extension rotation direction counter to the flexion rotation direction, a one-piece removable damping element having first and second free ends and an intermediate portion between said first and second free ends, said intermediate portion being connected to said upper and including said second extension element, each of said first and second free ends comprising a flexible plate which moves freely within a normal rotation range and which comes into abutment with the body between the normal rotation range and a maximum rotation range to produce a force in the transverse direction opposing the moving together of the first and second flexion elements and to produce a force in the transverse direction opposing the moving together of the first and second extension elements.

* * * * *